US007861493B2

(12) United States Patent
Monti

(10) Patent No.: US 7,861,493 B2
(45) Date of Patent: Jan. 4, 2011

(54) APPARATUS FOR FILLING TUBES WITH PILES OF DISC-SHAPED ARTICLES, SUCH AS PILLS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 448 days.

(21) Appl. No.: 11/946,415

(22) Filed: Nov. 28, 2007

(65) Prior Publication Data

US 2008/0156825 A1 Jul. 3, 2008

(30) Foreign Application Priority Data

Dec. 29, 2006 (IT) ..... BO2006A0899

(51) Int. Cl.
*B65B 57/00* (2006.01)
*B65B 35/50* (2006.01)
*B65B 3/28* (2006.01)

(52) U.S. Cl. ..... 53/53; 53/559; 53/474; 53/569; 53/238; 53/537; 493/239; 493/315; 493/317; 493/318; 493/313; 493/372; 493/221; 493/210; 493/206; 493/531; 493/198; 493/347.2

(58) Field of Classification Search ..... 221/210; 206/531; 53/53, 559, 474, 569, 238, 537; 493/239, 315, 317, 318, 313, 372; 198/347.2
See application file for complete search history.

(56) References Cited

U.S. PATENT DOCUMENTS 1,074,158 A * 9/1913 Bell ..... 227/118
4,338,083 A * 7/1982 Andrae ..... 493/239
4,674,935 A * 6/1987 Feliks et al. ..... 414/797.8
5,155,981 A * 10/1992 Tordini ..... 53/559
5,626,000 A * 5/1997 Edwards et al. ..... 53/281
6,070,385 A * 6/2000 Antonio ..... 53/53
6,443,326 B1 * 9/2002 Saito et al. ..... 221/163
6,499,270 B2 * 12/2002 Peroni et al. ..... 53/53
6,766,629 B2 * 7/2004 Smith et al. ..... 53/474
7,073,312 B2 * 7/2006 Battisti ..... 53/537
2004/0173437 A1 * 9/2004 Monti ..... 198/431
2006/0163033 A1 * 7/2006 Monti ..... 198/347.2

FOREIGN PATENT DOCUMENTS

EP 1 588 944 A 10/2005
FR 2 391 916 A 12/1978

* cited by examiner

*Primary Examiner*—Gene O. Crawford
*Assistant Examiner*—Rakesh Kumar
(74) *Attorney, Agent, or Firm*—William J. Sapone; Coleman Sudol Sapone P.C.

(57) ABSTRACT

An apparatus for filling tubes with piles of disc-shaped articles, such as pills, comprising: two functional elements (5*h*, 5*j*), hinged at a horizontal axis (K) and mobile between a loading region (C), in which the functional elements (5*h*, 5*j*) provide at least a corresponding seating (6) for receiving and retaining a relative pill (3) released by a plurality of supply units (1), and a disengagement region (D) of the pill (3), at which the functional elements (5*h*, 5*j*) are rotated by ninety degrees and cooperate with gripping organs (11); the gripping organs (11) being mobile in a vertical direction in order to gather the pill (3) borne by the functional elements (5*h*, 5*j*) into the relative disengagement region (D), and to release the pill (3) internally of a corresponding tube (10) in phase relation with the movement of the functional elements (5*h*, 5*j*).

14 Claims, 6 Drawing Sheets

APPARATUS FOR FILLING TUBES WITH PILES OF DISC-SHAPED ARTICLES, SUCH AS PILLS

BACKGROUND OF THE INVENTION

The invention relates to the technical sector of machines for filling tubes, that is rigid cylindrical containers, with piles of disc-shaped articles, in particular pills.

The prior art describes a similar typology of machines comprising: a conveyor belt, which draws pills towards a loading station; a transporter organ, overlying the conveyor belt, which bears empty tubes oriented vertically and with an opening thereof arranged downwards, respectively through the loading station and towards a capping station; the loading station, which comprises two vertically-developing archimedes screws located near to one another arranged in proximity of opposite sides of the conveyor belt at a relative transversal loading section, being activated in counter-rotation to one another in order to intercept, on opposite sides thereof, the pills coming from the section, to raise the pills vertically and push them internally of a corresponding overlying tube, stationary and waiting; and the capping station, in which the capping of the tubes filled with a given number of pills is performed. The conveyor belt, the conveyor organ and the archimedes screws are activated in phase relation to one another, and intermittently, to enable insertion of the pills internally of each tube halted in turn at the loading station.

SUMMARY OF THE INVENTION

In the light of the prior art, an aim of the present invention is to provide an apparatus for filling tubes with piles of disc-shaped articles, such as pills, which represents a new concept and also enables manipulation of fragile articles which have a tendency to crumble easily.

A further aim of the invention consists in providing an apparatus which satisfies the requisites of reliability, functionality and high productivity required in the sector under examination.

A further aim of the invention consists in making available an apparatus with relatively contained costs with respect to the advantages it provides.

The above aims are obtained by means of an apparatus for filling tubes with piles of disc-shaped articles, such as pills, which are released intermittently by at least a supply unit one after another, with a substantially vertical orientation, comprising: two functional elements which are hinged at a horizontal axis, which functional elements can be made to oscillate in phase relation with the release of the pills from the supply unit between a loading region, in which they are in proximity of the outlet section of the supply unit and in which each identifies at least a corresponding seating for receiving and retaining a relative pill released by the supply unit, and a disengagement region of the pill, in which the functional elements are rotated by a predetermined angle with respect to the horizontal hinge axis, enabling a gripping of the pill by gripping organs. The apparatus also comprises gripping organs, which are mobile according to a predetermined operating direction, which remove the pill borne by the functional elements into the relative disengagement region, and which release it internally of a corresponding tube in phase relation with the movement of the functional elements.

The apparatus in question advantageously satisfies the requisites of reliability, functionality and high productivity now required by the relevant sector; in particular, the apparatus enables manipulation of even fragile and easily crumbling articles, which are treated in the operating stages in such a way as not to compromise the integrity thereof.

BRIEF DESCRIPTION OF THE DRAWINGS

The characteristics of the invention which have not become clear from the foregoing will more fully emerge in the following claims and with the 10 aid of the appended figures of the drawings, in which:

DESCRIPTION OF THE PREFERRED EMBODIMENTS

Figure 2:
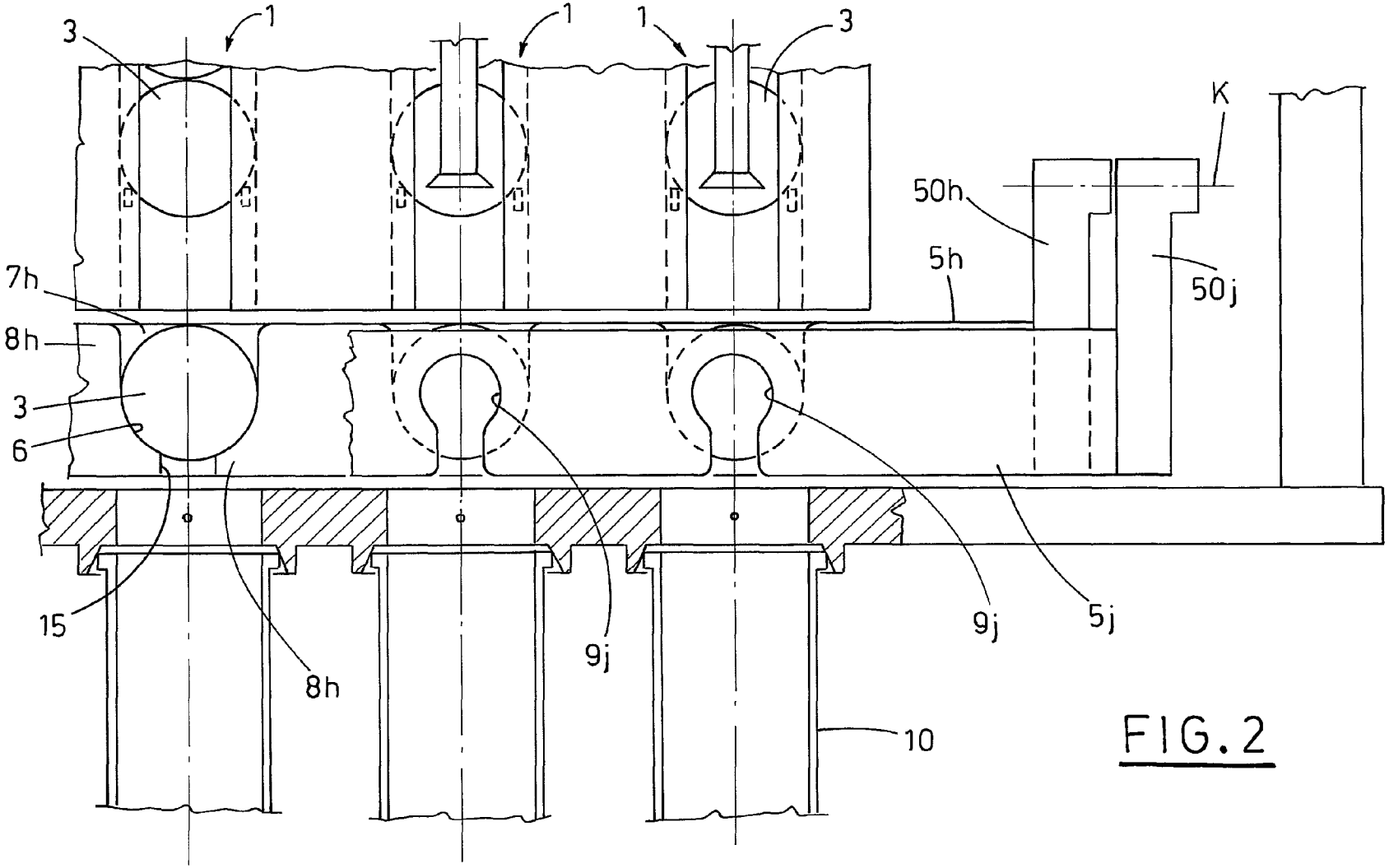
FIG. 2 is a partial frontal view of the apparatus of the operating stage of FIG. 1, in which some parts have been removed better to evidence others.

With reference to the accompanying figures of the drawings, 1 denotes a generalized supply unit of disc-shaped articles, such as pills, destined to release the articles from the relative outlet section SU one after another intermittently and with a substantially vertical orientation; the supply unit 1 belongs for example to a plurality of N supply units arranged side-by-side and preferably activated in synchrony (FIG. 2). The supply units 1 are, in the illustrated example, of known type and described in particular in Italian patent application BO2005A000657, belonging to the same applicant; each of these units 1 comprises: a vertical-axis channel 2 along which pills 3 (also oriented vertically) are supplied by force of gravity in a row; and a spoked element 4, interacting with the pills 3 supplied along the channel 2, step-activated to release therefrom one pill 3 at a time. In the example, the spoked element 4 exhibits an axis arranged perpendicularly with respect to the axis of the associated channel 2 and is provided with a plurality of radially-developing needle-shaped units **4*h*, each provided with a pair of distanced needles, which are in turn destined to exert a function of retaining a corresponding pill 3 and supporting overlying pills 3**.

**5*h* and 5*j* denote two functional elements, a first element and a second element, developing over all the lateral extension of the supply unit 1 (see FIG. 2) and connected at lateral ends thereof to respective operating arms 50*h*, 50*j* (FIG. 2 only illustrates the activating arms of a same end of the functional elements 5*h*, 5*j*) hinged at a common horizontal axis K and activated by actuator organs (not illustrated) which move the elements 5*h*, 5*j* between: a loading region C located at the outlet sections SU of the supply units 1, in which the elements 5*h*, 5*j* are arranged close to one another and oriented in a vertical direction, identifying seatings 6 for receiving and holding pills 3 in a position of stability, which pills 3 are released by the N number of supply units 1, as will be more fully explained herein below (FIGS. 1, 2, 6); and a disengagement region D (FIG. 3) in which the elements 5*h*, 5*j* are oriented for example in a horizontal direction, following rotation by 90° starting from the position assumed in the loading region C. In the disengagement region D the first element 5*h* is located at a lower height than the second element 5*j***.

Figure 1:
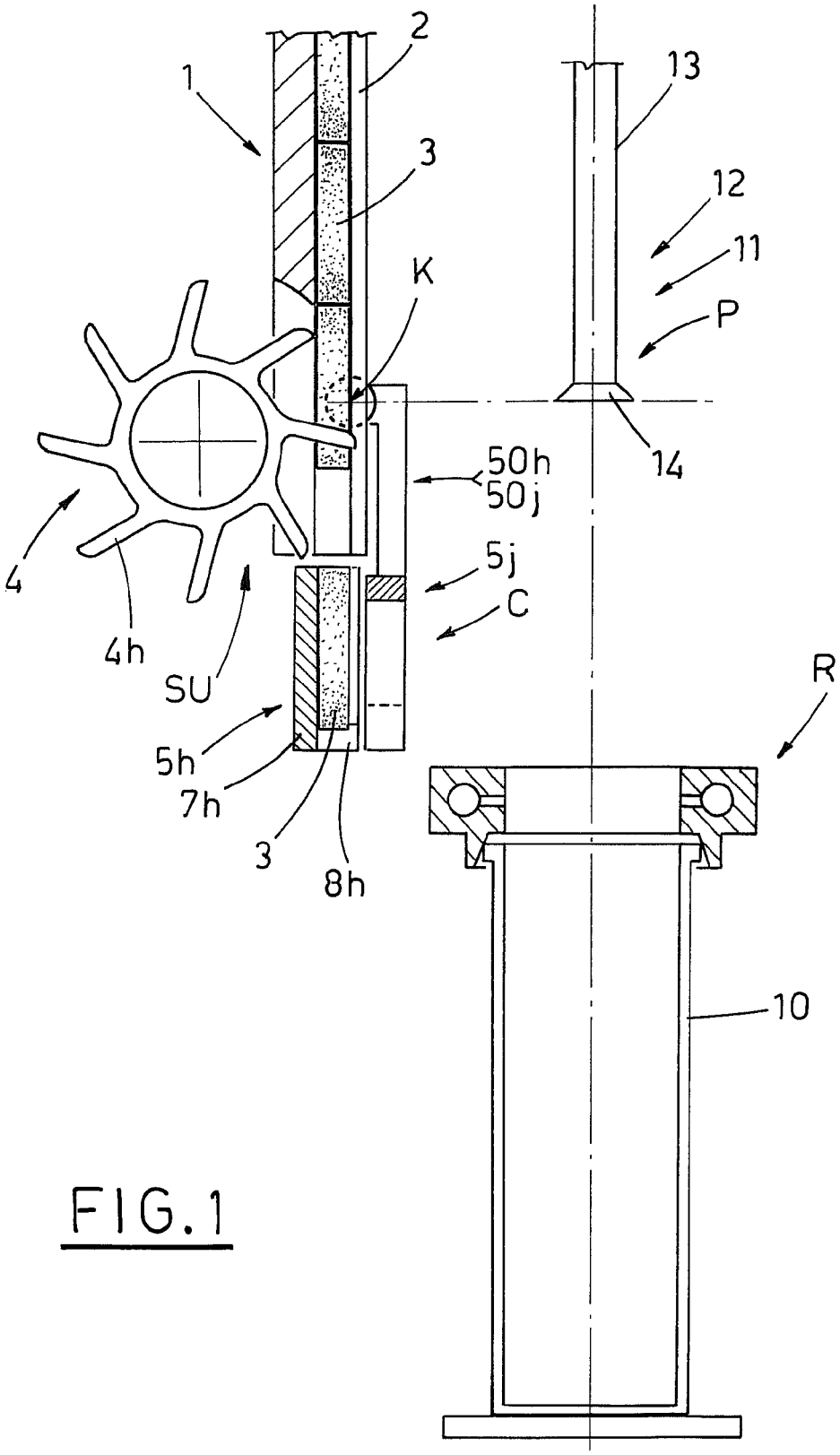
FIGS. 1, 3, 4, 5, 6 are corresponding schematic lateral views of the apparatus of the present invention, in five stages of an operating cycle.

In the illustrated example, with reference to FIGS. 1 and 2, in which the functional elements **5*h*, 5*j* are in the loading region C, the first element 5*h* is provided with a number of seatings 6 which is equal to the number of N outlet sections SU of the supply units 1, destined to receive corresponding pills 3 respectively released by the units 1. In particular, the seatings 6 are identified by a lateral wall 7*h* which constitutes a development surface of the first element 5*h* and by a plurality of shaped supports 8***h* fixed to the wall 7*h* and reciprocally intervalled, such that each seating 6 is identified by facing portions belonging to adjacent supports 8*h* and by the portion of wall 7*h* delimited by the supports 8*h* (FIG. 2); the pairs of facing portions are formed complementarily to the lower part of the pill 3 destined to be received in the seating 6 thus defined, thus advantageously guaranteeing stable retention in cooperation with the second element 5*j*, as will more clearly emerge herein below. The second element 5*j* affords lateral openings 9*j*, equal in number to the seatings 6, in the example of FIG. 2 each being constituted by a through-hole afforded perpendicularly to the development surface of the second element 5*j* and being laterally open towards the outside.

The elements 5*h*, 5*j*, arranged very closely to one another, exhibit the openings 9*j* of one superposed on the seatings 6 of the other, so that the pills housed therein are accessible from outside. The edges of the openings 9*j* also function as abutments for the pills 3, which are thus stably retained within the respective seatings 6 in the operating configurations, as will better emerge from the following description.

R denotes a station of known type for filling N tubes 10 at a time with piles of pills 3 released internally thereof by gripping organs 11 cooperating with the shaped elements 5*h*, 5*j*. The gripping organs 11, for example, are N aspirating units 12, each comprising a tubular element 13 terminating with a sucker 14 and functionally connected to a source in depression, not indicated in the figures; the aspiration units 12 are operated in a vertical direction in phase relation with the movement of the elements 5*h*, 5*j*, between a removal position P of the pills 3 borne by the elements 5*h*, 5*j*, and a release position PR of the pills internally of the corresponding tubes 10.

The apparatus for filling tubes of the present invention is now described, with reference to an operating cycle.

As has been mentioned, the supply units 1 operate in reciprocal synchrony, intermittently releasing pills 3 in phase relation with the activation of the elements 5*h*, 5*j*, of the aspiration units 12 and of the supply of tubes 10 into the filling station R.

With reference to FIGS. 1, 2, the shaped elements 5*h*, 5*j* are in the loading region C, close to one another and vertically-oriented, identifying the seatings 6 for receiving and stably retaining the pills 3 released by the overlying supply units 1; the pills 3 thus released insert in the corresponding seatings 6, maintaining the relative vertical orientation thereof thanks to the abutment action of the edges of the lateral openings 9*j* of the second element 5*j*.

Figure 3:
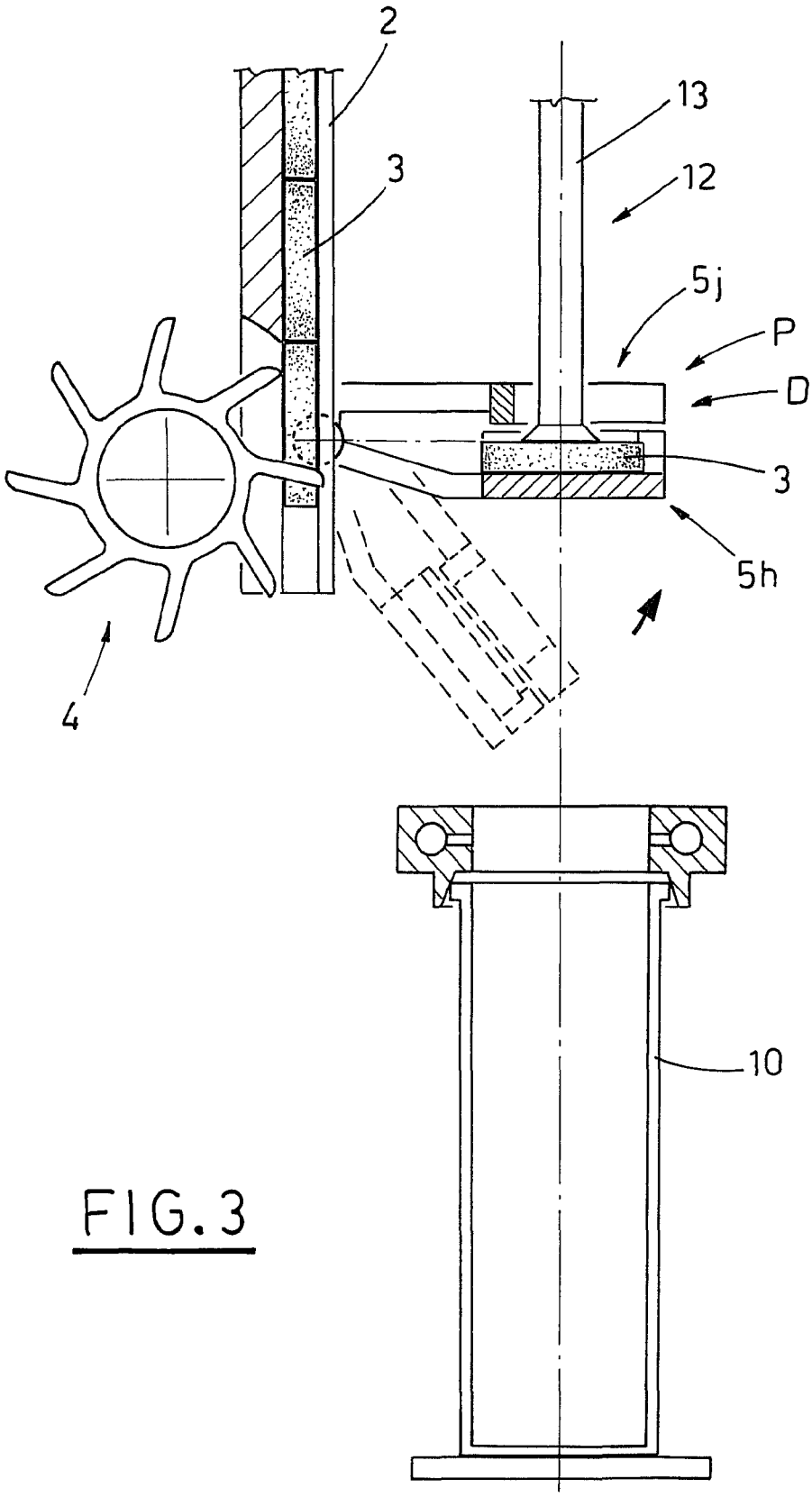

The synchronized movement of the elements 5*h*, 5*j* follows, towards the disengagement area D, during which the elements 5*h*, 5*j* are rotated about the horizontal hinge axis K, maintaining the same reciprocal position of stable retention of the pills 3 in the respective seatings 6. In the example illustrated in the figures, the removal position P assumed by the aspiration units 12 is such that the second element 5*j*, on reaching the disengagement region D, inserts between the terminal portions of the units 12 at the position of the relative lateral openings 9*j*, until the suckers 14 are almost touching the corresponding pills 3 (FIG. 3). The shaped elements 5*h*, 5*j* end their run in the disengagement region D, assuming a horizontal position, as do the pills 3 they are transporting.

In phase relation with the arrival of the elements 5*h*, 5*j* in the disengagement region D, the units 12 are activated in aspiration in order to grip the pills 3 still retained by the elements 5*h*, 5*j*.

Figure 4:
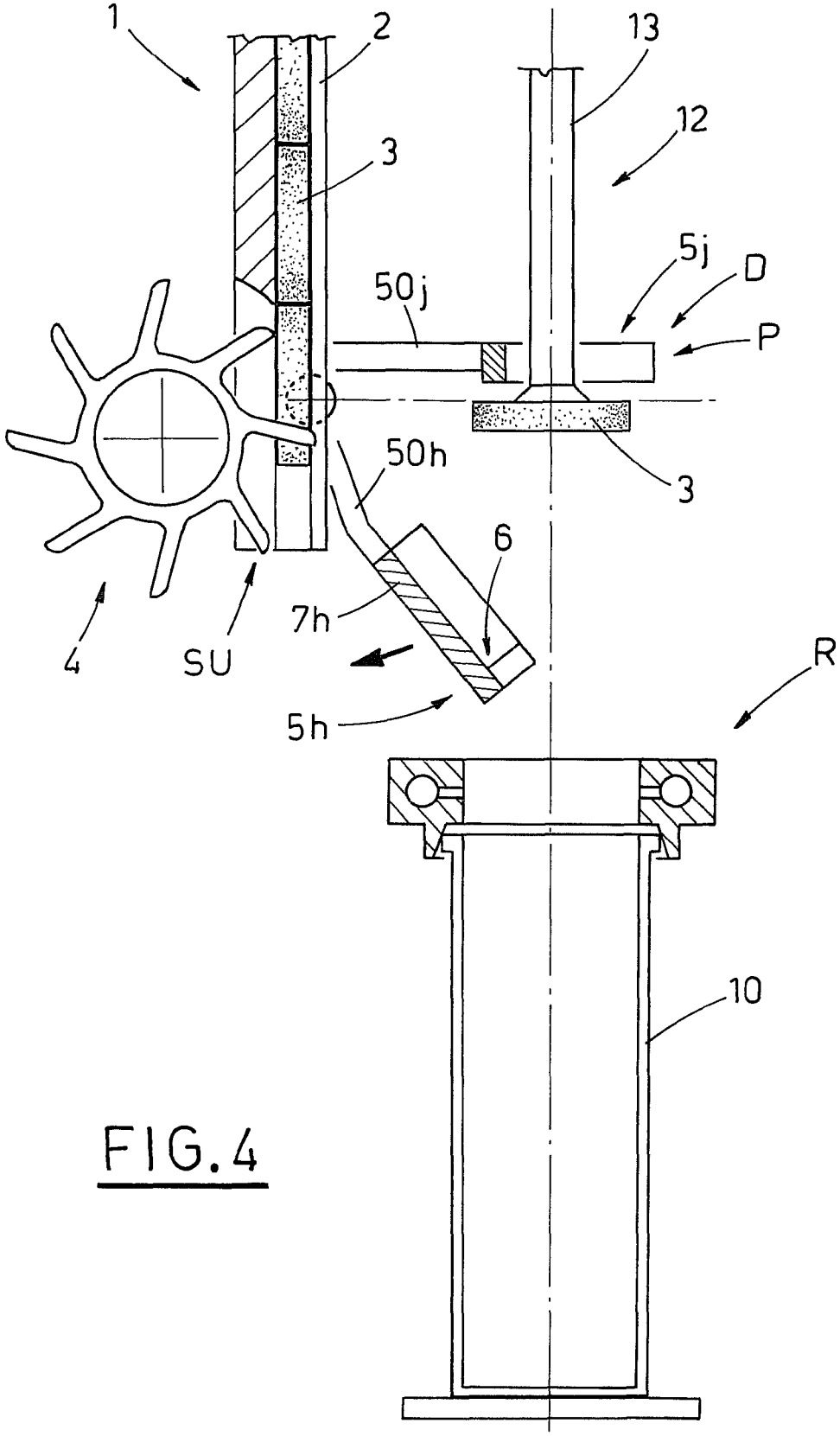
Figure 5:
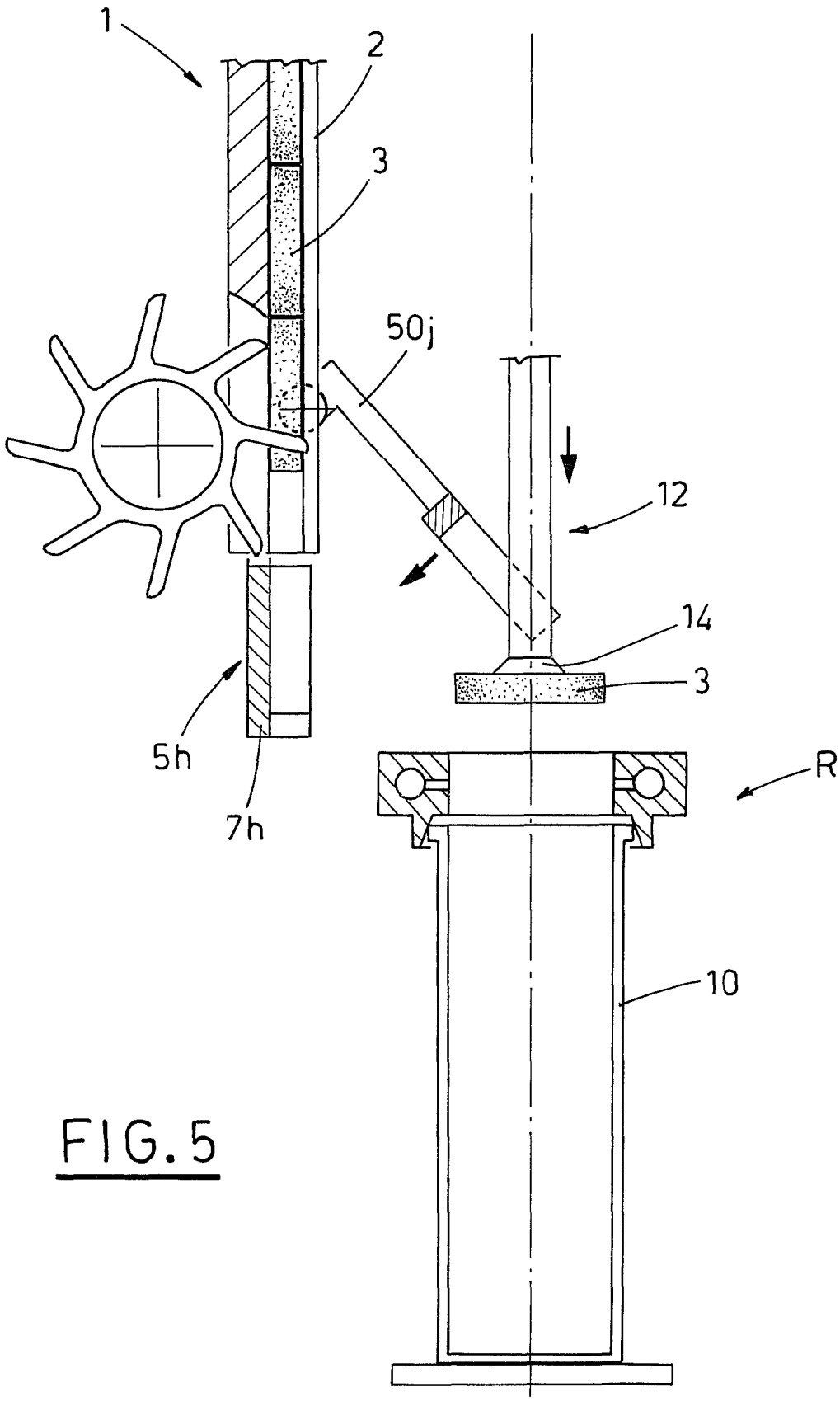
Figure 6:
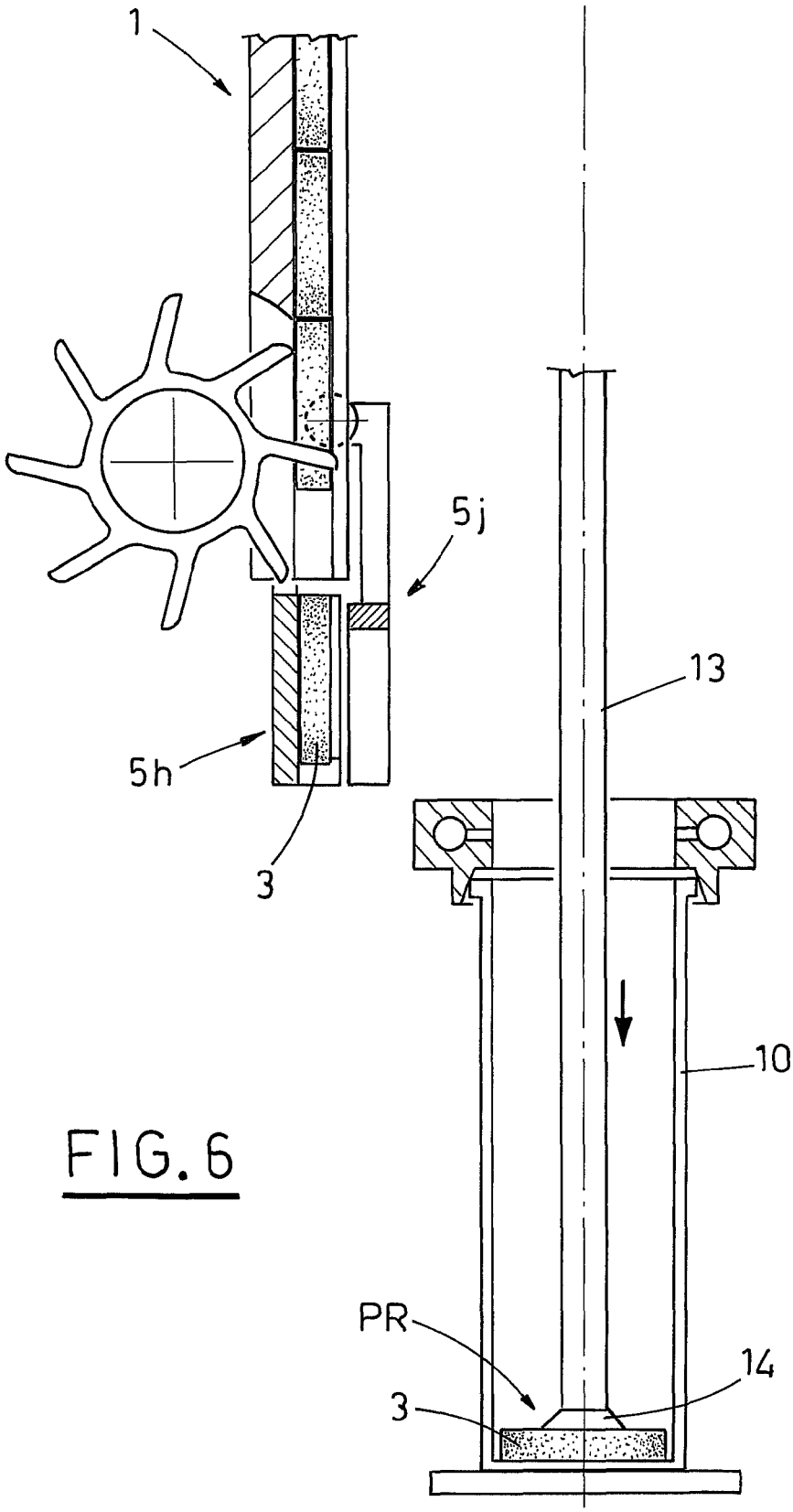

The first element 5*h* (lower element) then returns towards the loading region (FIG. 4) and the aspiration units 12 move vertically, retaining the corresponding pills 3, towards the relative release position PR (the height of which depends time by time on the filling level of the tubes 10) in the station R, to fill the tubes 10 (FIG. 6). Following the movement of the aspiration units 12 towards the release position PR, the second element 5*j* is returned to the loading region C, concluding an operating cycle, so that it does not interfere with the gripping action on the pills 3 performed by the aspirating units 12.

Each seating 6 advantageously exhibits a lower opening 15 identified by the interspace between the adjacent shaped supports 8*h*. This enables discharging of the powder produced by the pills 3, released by the supply units 1 and/or being generated following insertion of the pills 3 internally of the seatings 6.

A further advantage of the invention consists in having defined an apparatus the costs of which are relatively contained with respect to the advantages obtained.

Alternatively to the lateral openings 9*j* afforded in the second element 5*j*, corresponding through-holes of a suitable diameter can be afforded; in this case the return of the second element 5*j* into the loading region C can be done only when the aspiration unit 12 has returned into the removal position P, following the release of the pills 3 into the tubes 10.

The suckers 14 are adapted to the shape of the pills 3, in order to optimize the gripping action thereon.

In general the gripping organs 11 can be of any shape and type, even different from the shape illustrated herein, and the angle that the elements 5*h*, 5*j* rotate through can be different from ninety degrees.

The foregoing description is provided by way of non-limiting example, and any variations of a practical-applicational nature can be made thereto without its forsaking the ambit of protection as described above and as claimed herein below.

What is claimed is:

1. An apparatus for filling tubes with piles of disc-shaped pills, the pills (3) being in a substantially vertical orientation and released intermittently one after another by at least one supply unit (1), the apparatus comprising:

two functional elements (5*h*, 5*j*), hinged at a horizontal axis (K) thereof which oscillate, in phase relation, with a release of each pill from the supply unit (1), between a loading position (C), in which the functional elements (5*h*, 5*j*) are near to an outlet section (SU) of the at least one supply unit (1) for receiving a vertically oriented pill therein and are mutually arranged to provide corresponding seat (6) for receiving and retaining the disk-shaped pill (3) released by the supply unit (1) and a disengagement position (D), at which the functional elements (5*h*, 5*j*) are rotated by a predetermined angle to a position coinciding with respect to the horizontal hinge axis (K), the disk-shaped pill thus moved into a corresponding horizontal orientation, gripping organs (11) provided for gripping the pill when seated on the functional elements in the disengagement position, the gripping organs holding the pill as at least one functional element rotates back to the loading position, the gripping organs being movable in a predetermined operating direction for depositing the pill (3) as the functional element moves away from the disengagement position (D), the gripping organs releasing each pill (3) inside of a corresponding tube (10) in phase relation with the movement of the functional elements (5*h*, 5*j*).

2. The apparatus of claim 1, wherein the angle by which the functional elements (5*h*, 5*j*) are rotated between the loading position (C) and the disengagement position (D) is a ninety-degree angle and wherein the gripping organs (11) comprise sucker means (14) functionally connected to a vacuum source, which gripping organs (11) are movable in a vertical direction between a gripping position P and a release position (PR) located within the tube (10).

3. The apparatus of claim 1, wherein the functional elements (5*h*, 5*j*) comprise a first shaped element and a second shaped element (5*h*, 5*j*), respectively borne by at least an activating arm (50*h*, 50*j*), hinged to the horizontal axis (K), the first shaped element (5*h*) having a shape for receiving the disk-shaped pill (3) released by the at least one supply unit (1) and the second shaped element (5*j*) having at least an abutment portion for ensuring retention of the pill (3) in the seat formed when the shaped elements (5*h*, 5*j*) are in the loading position (C) and during the movement of the shaped elements (5*h*, 5*j*) towards the disengagement position (D).

4. The apparatus of claim 3, wherein the second shaped element (5*j*) further has a through-hole (9*j*) made in a perpendicular direction relative to a development surface of the second shaped element (5*j*), for enabling the gripping organs (11) to grip a surface of the pill residing on the seat when the functional elements are in the disengagement position (D).

5. The apparatus of claim 4, wherein the through-hole (9*j*) is laterally open towards an outside.

6. The apparatus of claim 5, wherein the gripping organs (11) comprise a shank (13) which freely passes through the lateral opening (9*j*).

7. The apparatus of claim 3, wherein the first shaped element (5*h*) comprises a lateral wall (7*h*) and at least two shaped supports (8*h*) fixed thereto, one along side of another, the seat being formed by facing portions of the shaped supports (8*h*) and by a corresponding portion of the lateral wall (7*h*) delimited by the facing portions of the shaped supports (8*h*).

8. The apparatus of claim 7, wherein the facing portions substantially have a shape which complements a lower profile of the disk-shaped pill.

9. The apparatus of claim 2, wherein the functional elements (5*h*, 5*j*) comprise a first shaped element and a second shaped element (5*h*, 5*j*), respectively borne by at least an activating arm (50*h*, 50*j*), hinged to the horizontal axis (K), the first shaped element (5*h*) having a shape for receiving the disk-shaped pill (3) released by the at least one supply unit (1) and the second shaped element (5*j*) having at least an abutment portion for ensuring retention of the pill (3) in the seat formed when the shaped elements (5*h*, 5*j*) are in the loading position (C) and during the movement of the shaped elements (5*h*, 5*j*) towards the disengagement position (D).

10. The apparatus of claim 3, wherein the second shaped element (5*j*) further has a through-hole (9*j*) made in a perpendicular direction relative to a development surface of the second shaped element (5*j*), for enabling the gripping organs (11) to grip a surface of the pill residing on the seat when the functional elements are in the disengagement position (D).

11. The apparatus of claim 10, wherein the through-hole (9*j*) is laterally open towards an outside.

12. The apparatus of claim 11, wherein the gripping organs (11) comprise a shank (13) which freely passes through the lateral opening (9*j*).

13. The apparatus of claim 9, wherein the first shaped element (5*h*) comprises a lateral wall (7*h*) and at least two shaped supports (8*h*) fixed thereto, one along side of another, the seat being formed by facing portions of the shaped supports (8*h*) and by a corresponding portion of the lateral wall (7*h*) delimited by the facing portions of the shaped supports (8*h*).

14. The apparatus of claim 13, wherein the facing portions substantially have a shape which complements a lower profile of the disk-shaped pill.

* * * * *